US006338508B1

(12) United States Patent
Kleefeldt

(10) Patent No.: US 6,338,508 B1
(45) Date of Patent: Jan. 15, 2002

(54) MOTOR-VEHICLE LATCH SYSTEM WITH POWER OPEN

(75) Inventor: Frank Kleefeldt, Heiligenhaus (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/526,111

(22) Filed: Mar. 15, 2000

(30) Foreign Application Priority Data

Mar. 24, 1999 (DE) ..... 199 13 390

(51) Int. Cl.[7] ..... E05L 3/06

(52) U.S. Cl. ..... 292/201; 242/216; 70/264

(58) Field of Search ..... 70/264; 292/216, 292/201, DIG. 23

(56) References Cited

U.S. PATENT DOCUMENTS

| | | | | |
|---|---|---|---|---|
| 4,974,886 A | * | 12/1990 | Kleefeldt et al. | 292/201 |
| 5,419,597 A | * | 5/1995 | Brackmann et al. | 292/201 |
| 5,638,712 A | * | 6/1997 | Kuroda | 70/268 |
| 5,667,260 A | * | 9/1997 | Wyerstall | 292/201 |
| 5,699,685 A | * | 12/1997 | Jahrsetz et al. | 70/264 |
| 5,715,713 A | * | 2/1998 | Aubry et al. | 292/216 |
| 5,762,384 A | * | 6/1998 | Bartel | 292/216 |
| 5,765,884 A | * | 6/1998 | Armbruster | 292/216 |
| 5,802,894 A | | 9/1998 | Jahrsetz | |
| 5,853,206 A | * | 12/1998 | Kleefeldt et al. | 292/201 |
| 6,145,354 A | * | 11/2000 | Kondo et al. | 70/279.1 |
| 6,168,216 B1 | * | 1/2001 | Nakajima et al. | 292/201 |

FOREIGN PATENT DOCUMENTS

| | | |
|---|---|---|
| EP | 0 896 118 | 2/1998 |

* cited by examiner

*Primary Examiner*—Robert J. Oberleitner
*Assistant Examiner*—Devon Kramer
(74) *Attorney, Agent, or Firm*—Herbert Dubno; Andrew Wilford

(57) ABSTRACT

A door latch for a motor-vehicle central-latch system has a housing, a locking element displaceable on the housing between a door-bolt-holding position and a door-bolt-releasing position, and a pawl displaceable on the housing between a retaining position holding the locking element in its bolt-holding position and a freeing position allowing the locking element to assume its bolt-releasing position. A release lever pivotal on the housing into an actuated position can put the paws into the freeing position. A outside operating lever is pivotal on the housing between actuated and unactuated positions and a main locking lever is pivotal on the housing by an electric motor between locked and unlocked positions. A link engageable between the main locking lever, the outside operating lever, and the release lever serves for, when the main locking lever is in the unlocked position and the outside operating lever is in its unactuated position, coupling the outside operating lever to the release lever to displace same into its freeing position on movement of the outside operating lever into its actuated position. When the main locking lever is in the locked position and the outside operating lever is in its actuated position, the link displaces the release lever into its freeing position on movement of the main locking lever into its unlocked position. Normally the link, when the main locking lever holds in the locked position, decouples the outside locking lever from the release lever.

7 Claims, 6 Drawing Sheets

VI
5a
5
5b
5c
15
18"
16'
33"
22
37
22a
23
22b
16"
18'
15A
17
12
19
B
A
33'
29
38
31
30
20
33
32
28
21
14
24
25
10
8
13
26
27
2
VI

MOTOR-VEHICLE LATCH SYSTEM WITH POWER OPEN

FIELD OF THE INVENTION

The present invention relates to a motor-vehicle latch system. More particularly this invention concerns such a system which has actuators in the latch and a central controller for power opening any of the latches.

BACKGROUND OF THE INVENTION

In a standard motor-vehicle central-lock system all of the door latches, even any latches of the trunk or gas-filler cover, are operated by a central controller and can each be moved between a latched position holding the respective door or lid closed and an unlatched position allowing it to open. Each passenger or driver door latch also normally has an outside operating handle and can also be moved between an unlocked position in which actuation of the respective outside handle shifts the latch into the unlatched position and a locked position in which actuation of the outside handle does nothing. Furthermore each latch normally comprises a fork engageable around a bolt extending from the door post, a pawl that can retain the fork in a position engaged around the door bolt and that can release the fork to allow the door to open. This fork/pawl structure is operated through a main locking lever shiftable between the above-described locked and unlocked positions by means of a respective small electrical drive operated by the central controller.

The controller can in turn be triggered by an operator normally carried by the driver. In the most sophisticated keyless-entry systems, the driver simply carries a small transponder that communicates with the controller to unlock the latches as the driver approaches his or her vehicle. Similarly the operator could be a standard push-button remote or a smart card. It could even be a standard edge-bitted key.

As described in EP 0,896,113 of Hochart and Girard the drive of each latch can also directly or indirectly move the latch from the latched to the unlatched position. To this end a release lever has an edge that coacts with a pin on the fork-retaining pawl. Pivoting the release lever requires considerable torque, so the drive motor for the latch must be fairly powerful. This largely loses the advantage of the standard central-system latches where a relatively small motor is used to move between the locked and unlocked positions.

In U.S. Pat. No. 5,802,894 of Jahrsetz a central control system for the door latches of a motor vehicle has a central unit connected to the door latches via a control line and the door latches each have a first electrically-operable actuator and a second electrically-operable actuator together enabling the "operate", "locked and unlocked", "antitheft mode on and off" and "child-safety mode on and off" operations. The door latches can be mechanically identical and can have a keeper pawl controlled both by the first actuator and an interior lever which is effective only when the second operator has displaced a lever from its ineffective position into an effective position.

These central lock systems which employ the drive in the latch to effect the unlatching movement have the considerable disadvantage that, if the vehicle power fails, the doors cannot be opened from inside or out unless they have, in addition to the motor-powered actuation, a complete mechanical linkage. The alternative to providing such a redundant mechanical linkage is a redundant power supply which is not normally considered a reasonable option.

OBJECTS OF THE INVENTION

It is therefore an object of the present invention to provide an improved door latch for a central motor-vehicle latch system.

Another object is the provision of such an improved door latch for a central motor-vehicle latch system which overcomes the above-given disadvantages, that is which is of relatively simple construction but which can be locked and unlocked and latched and unlatched both by an individual mechanical linkage and an individual motor drive.

The invention is aimed at producing such a lock which, in spite of parallel powered and mechanical systems, is of simple and inexpensive construction.

SUMMARY OF THE INVENTION

A door latch for a motor-vehicle central-latch system having a central electronic controller and an operator for the controller latch has according to the invention a housing, a locking element displaceable on the housing between a position holding a door bolt and a position releasing the door bolt, and a pawl displaceable on the housing between a retaining position holding the locking element in its bolt-holding position and a freeing position allowing the locking element to assume its bolt-releasing position. A release lever pivotal on the housing into an actuated position can put the pawl into the freeing position and an outside operating lever is pivotal on the housing between actuated and unactuated positions. A main locking lever is pivotal on the housing between locked and unlocked positions. An electric motor in the housing can displace the main locking lever between its locked and unlocked positions. A link engageable between the main locking lever, the outside operating lever, and the release lever serves for, when the main locking lever is in the unlocked position and the outside operating lever is in its unactuated position, coupling the outside operating lever to the release lever to displace same into its freeing position on movement of the outside operating lever into its actuated position. When the main locking lever is in the locked position and the outside operating lever is in its actuated position, the link displaces the release lever into its freeing position on movement of the main locking lever into its unlocked position. Normally the link, when the main locking lever holds in the locked position, decouples the outside locking lever from the release lever.

Thus with this system the drive motor can function, as is standard, to switch the latch between its locked and unlocked conditions. In the locked position actuation of the outside operating handle is not transmitted to the release lever by the link. According to the invention, however, if the drive motor attempts to move the locking lever into the unlocked position while the outside operating lever is actuated, the locking lever is effectively coupled to or acts on the release lever to trip it and unlatch the latch. Thus the same drive motor can serve both to lock and unlock the latch and to unlatch it. It is not necessary to provide a second drive motor for the unlatching function.

The drive in accordance with the invention includes a worm mounted on the drive motor, a worm wheel meshing with the worm, and an eccentric on the worm wheel engageable with the main locking lever. The main locking lever has a forked end formed with a recess in which the eccentric is engageable. Of course the release lever can also be actuated directly by means of an inside door handle, and the main locking lever can also be directly actuated by means of an inside lock button or the like.

The main locking lever and release lever are formed according to the invention with crossing slots and the link is engaged in both of the slots. More particularly the link is a pin engaged through both of the slots and provided with a retaining disk between the main locking and release levers. Alternately as shown in above-cited U.S. Pat. No. 5,802,894, the link can be a lever pivoted on the latch.

The outside operating lever is pivotal on the housing about an axis parallel to axes of rotation of the main locking and release levers. In addition the outside operating lever has an angled cam edge engageable with the link in the actuated position of the outside operating lever on movement of the main locking lever from the locked position to the unlocked position. Thus as the link pin is moved by the main locking lever while engaged in the slot of the release lever, it is cammed to the side to actuate the release lever. The travel along the cam edge can be relatively long for considerable mechanical advantage so a relatively weak drive motor can be used.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
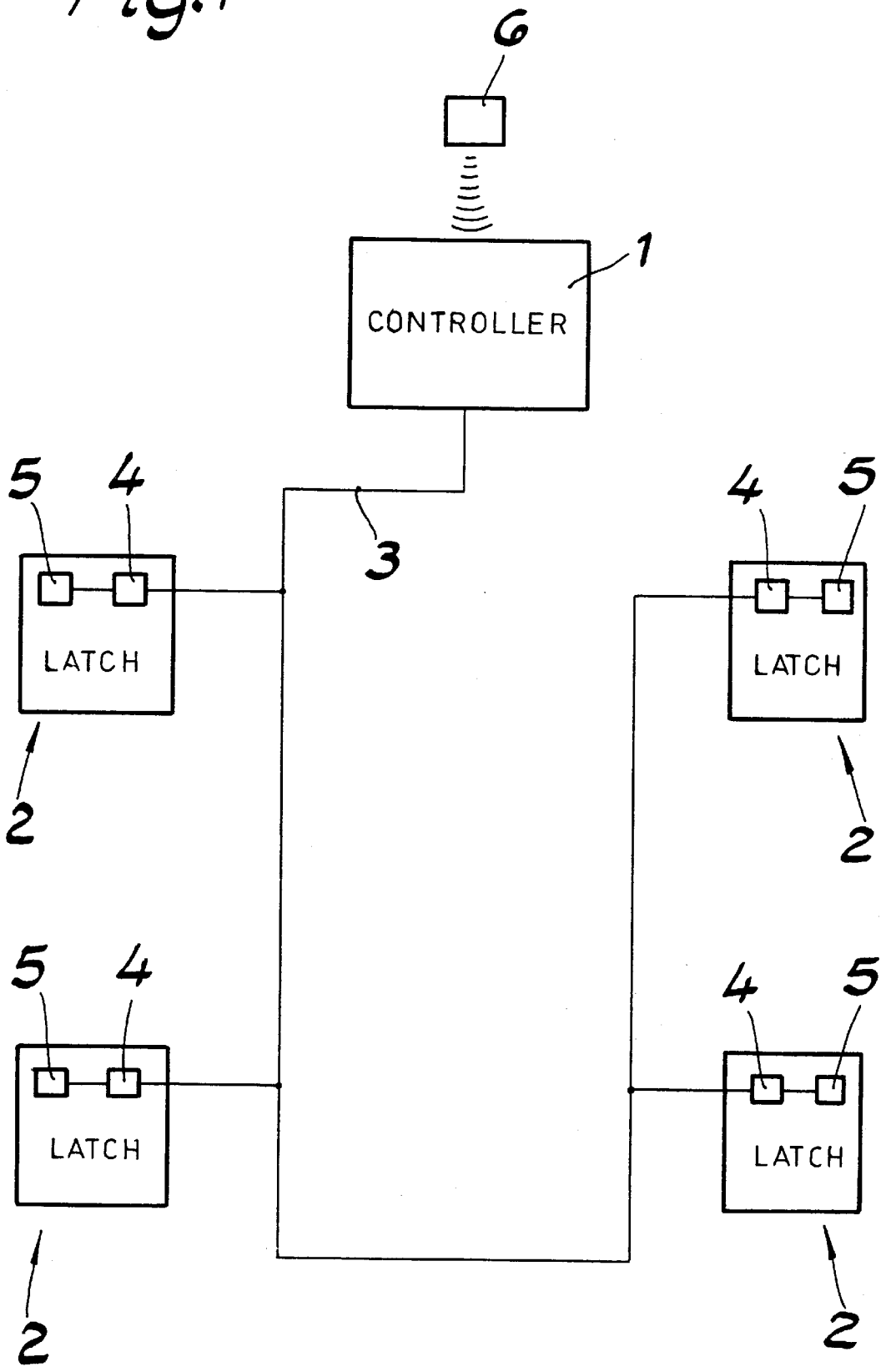
FIG. 1 is a schematic diagram illustrating a latch system according to the invention.

As seen in FIG. 1 a central electronic controller 1 is connected to a plurality of identical power door latches 2, where one for each of four doors, via a serial-bus line 3 with a multiplexer and demultiplexer as described in above-cited U.S. Pat. No. 5,802,894. Each latch 2 includes its own operating circuit 4 that in turn controls an electrical drive 5 that serves for displacing the latch 2 between locked and unlocked conditions and that can actually unlatch the latch under certain conditions. The controller 1 coacts with an operator 6 that can be a remote transmitter, a smart card, a transponder, or a simple key. In a standard system it is a transponder carried by the user and capable of being sensed when in close proximity to the vehicle having the latches 2 and controller 1. Thus the user carrying the operator 6 is detected as he or she approaches the vehicle and as described below the controller 1 unlocks all the latches 2 and even unlatches any latch 2 that is being actuated. The operator serves for identifying the person carrying it, by a comparison between an identity code word stored in the controller and an identity code word outputted by or read from the transponder. A passive system such as in German 197 01 077 is also usable.

Figure 2:
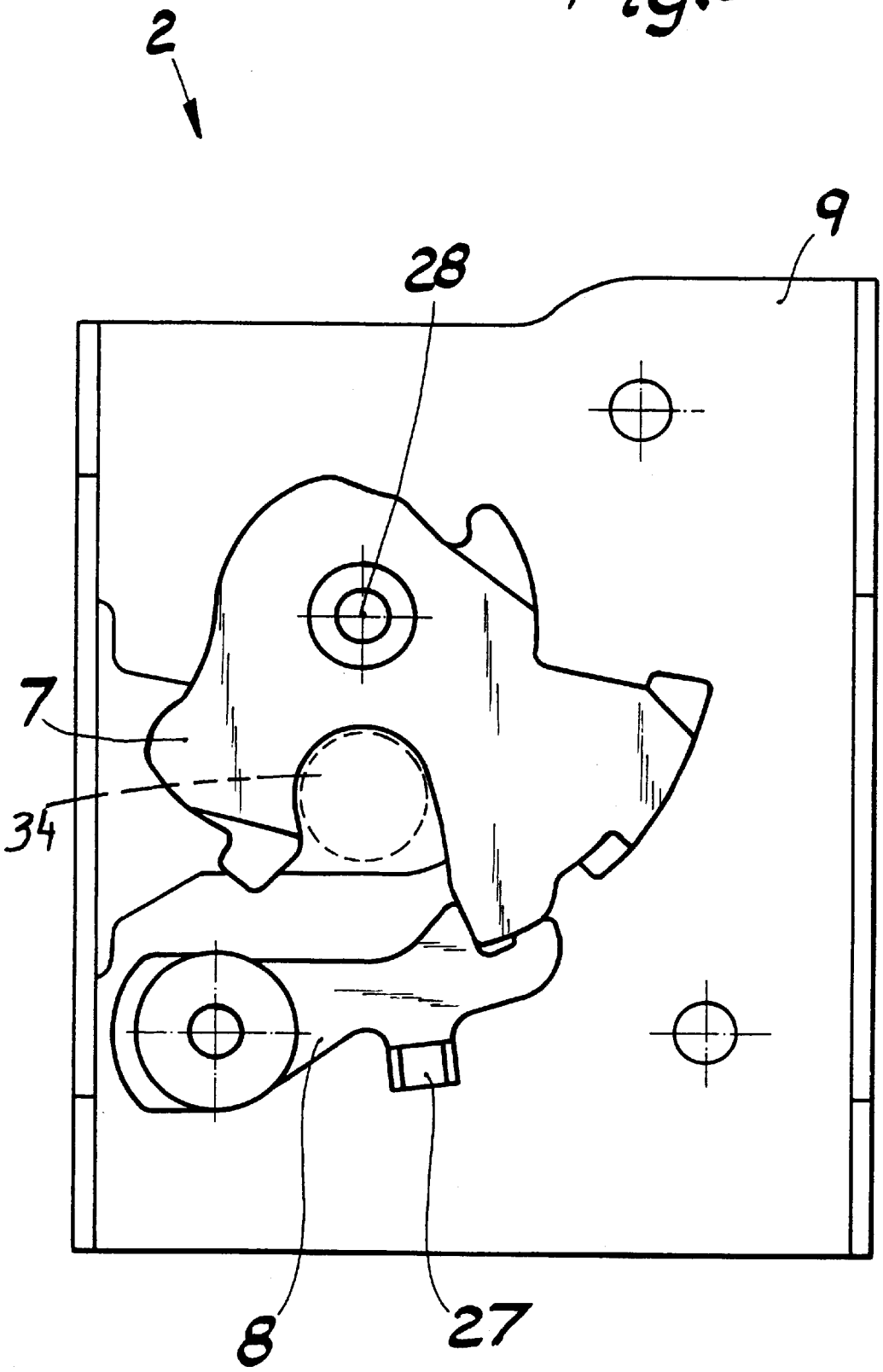
FIG. 2 is a side view of one of the latches of the system.
Figure 6:
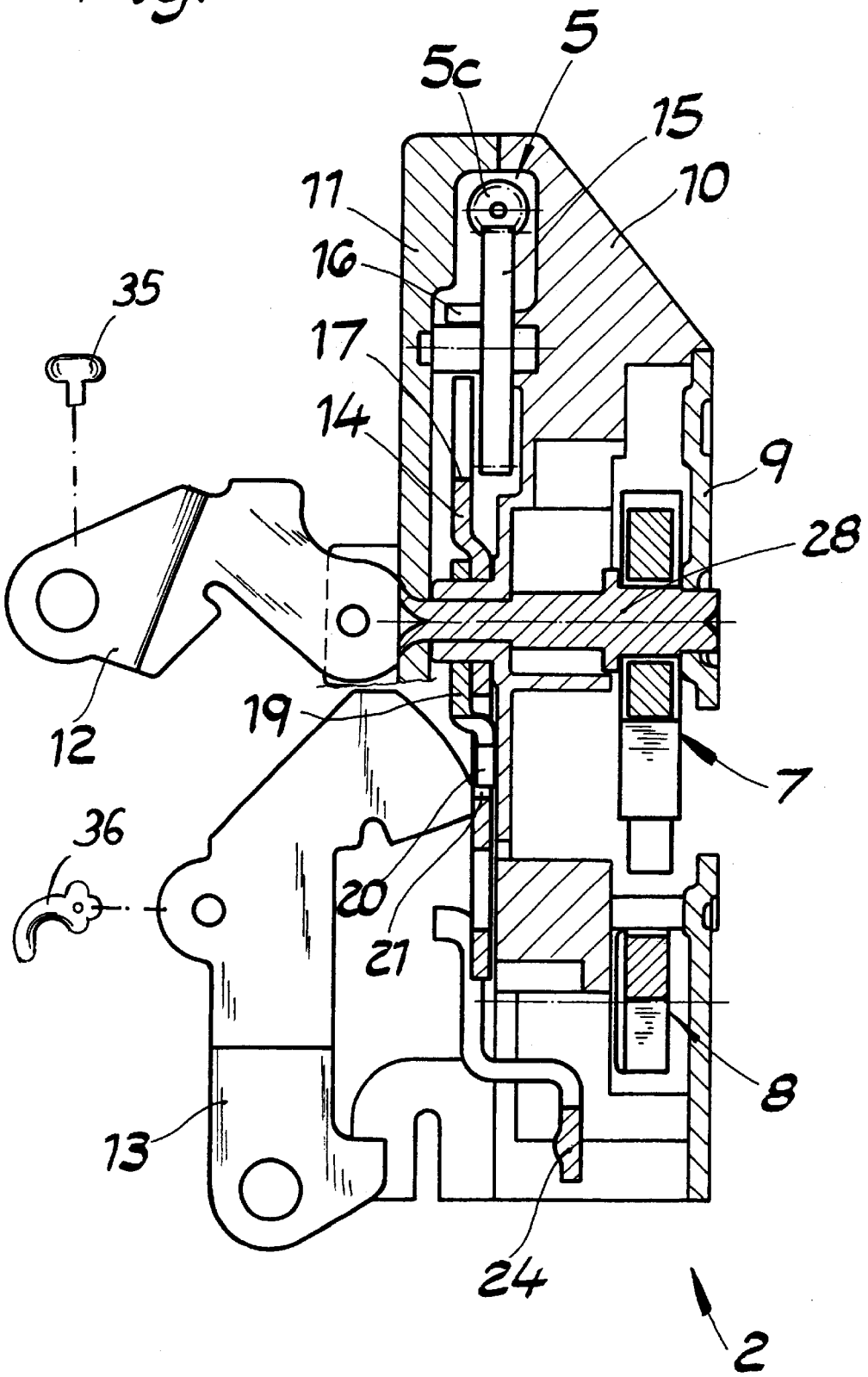
FIG. 6 is a section taken along line VI—VI of FIG. 1.

FIGS. 2 and 6 show how one of the latches 2 has a housing 9 comprised of a body 10 and a cover 11 carrying a fork 7 pivotal on a shaft 28 and securable by a pawl 8 about a door-post bolt 34. An inside locking lever 12 operable by a door button 35 and an inside latching or operating lever 13 operated by an inside handle 36 are both mounted on the inside face of the housing 9.

Inside the housing 9 a main locking lever 14 is pivotal on the fork pivot 28 adjacent a worm wheel 15. The drive 5 comprises a reversible electric motor **5*a* having an output shaft 5*b* carrying a worm 5*c* meshing with the wheel 15. This wheel 15 in turn carries a pair of diametrically opposite eccentric pins 16' and 16" that serve to pivot the locking lever 14 between the unlocked positions shown in FIGS. 3 and 5 and the locked position of FIG. 4. To this end the lever 14 has an end cutout 17 flanked by a pair of cam surfaces 18' and 18" that can be positioned to extend radial of the axis 15A of the wheel 15**.

Figure 3:
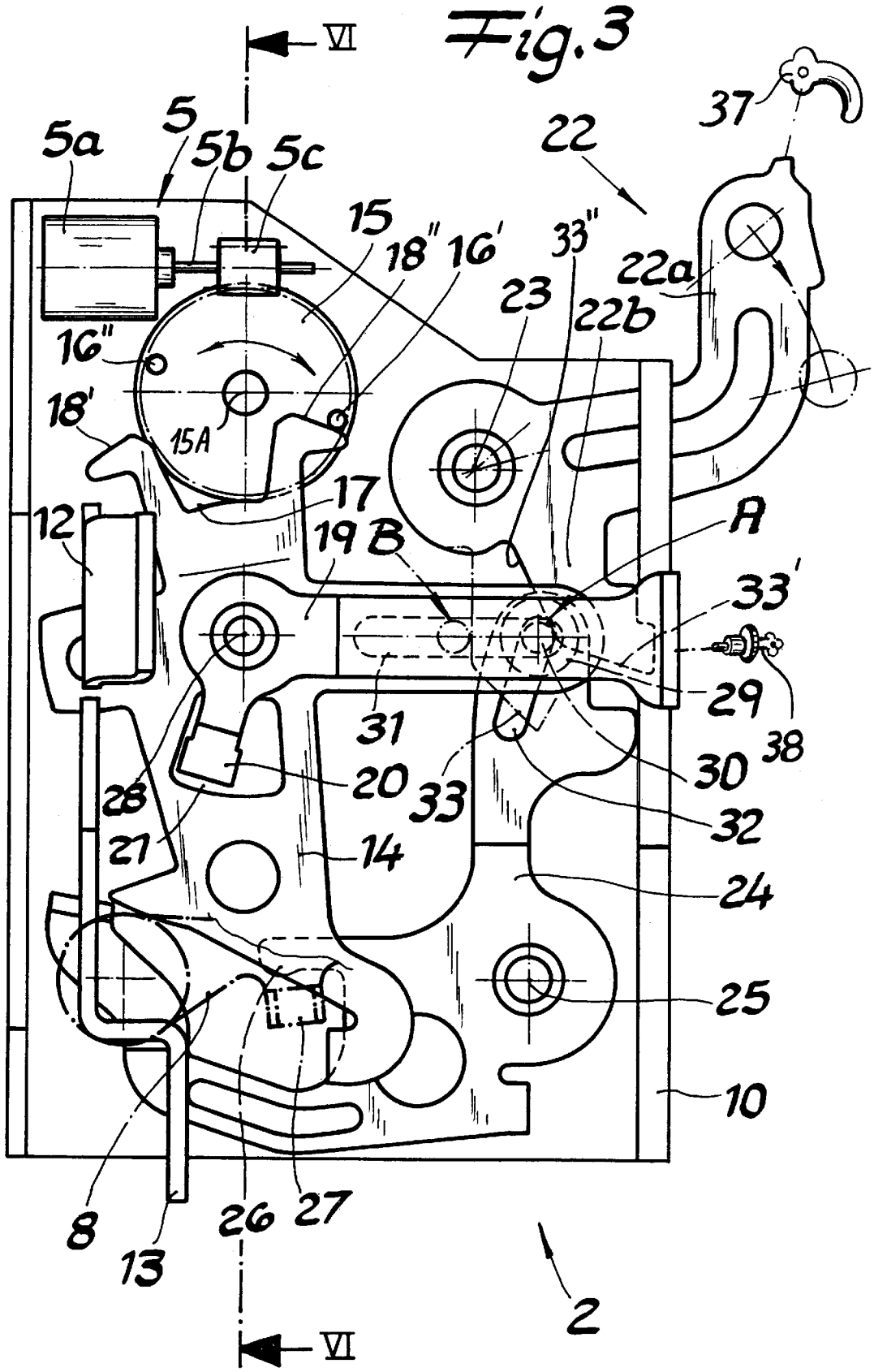
FIG. 3 is an opposite side view of the latch in the unlocked and unactuated position.

An outside locking lever 19 is connected to the main locking lever 14 by a lost-motion coupling constituted by a narrow tab 20 on the lever 19 projecting into a wide cutout 21 in the lever 14. This lever 19 is normally operated by an outside key cylinder 38 as shown in FIG. 3. In addition an outside operating or latching lever 22 is pivoted at 23 on the housing 9 and has one arm **22*a* connected to an outside door handle 37 and an opposite arm 22*b* forming a pair of cam surfaces 33' and 33"**.

Figure 4:
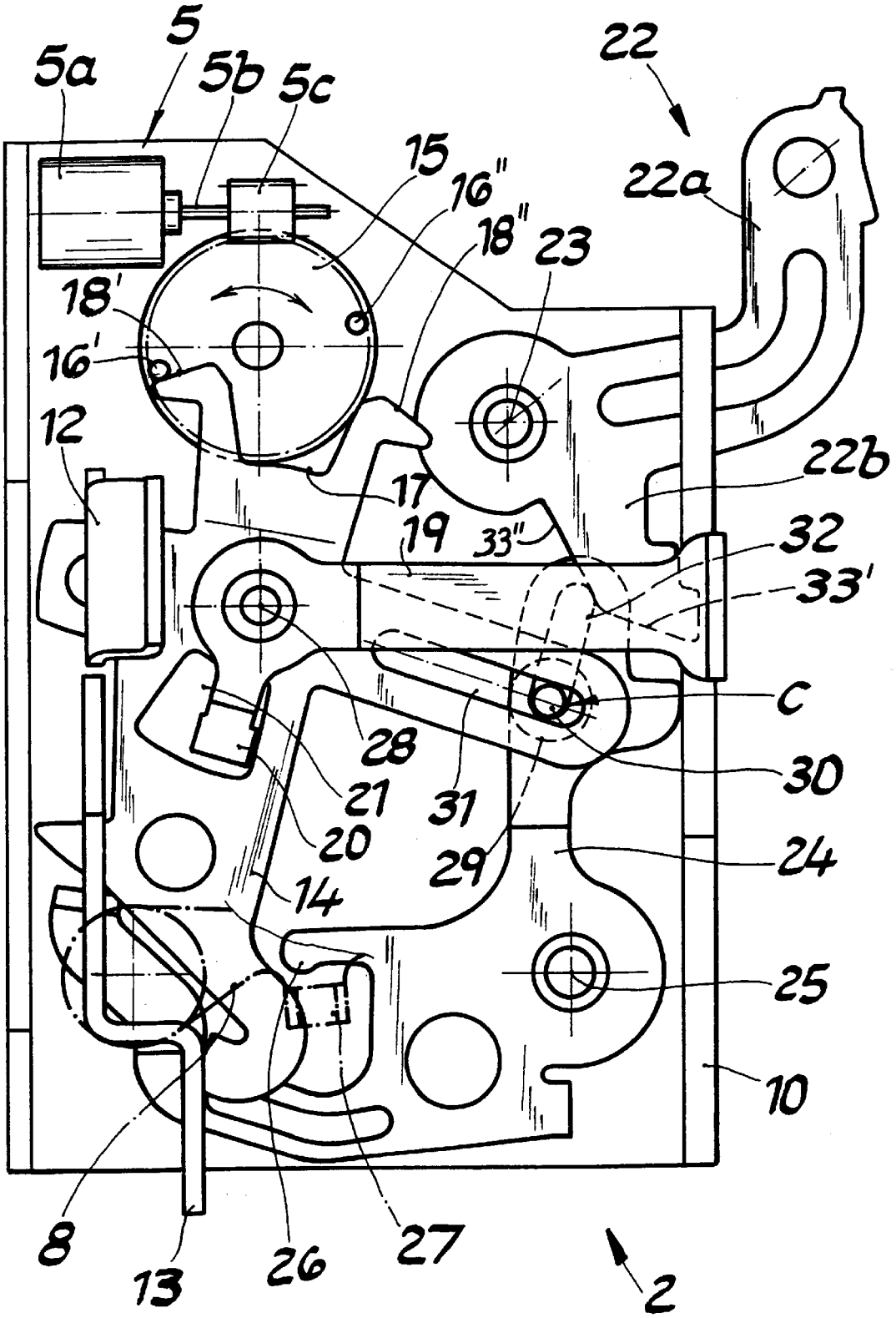
FIG. 4 is a view like FIG. 3 in the locked and unactuated position.
Figure 5:
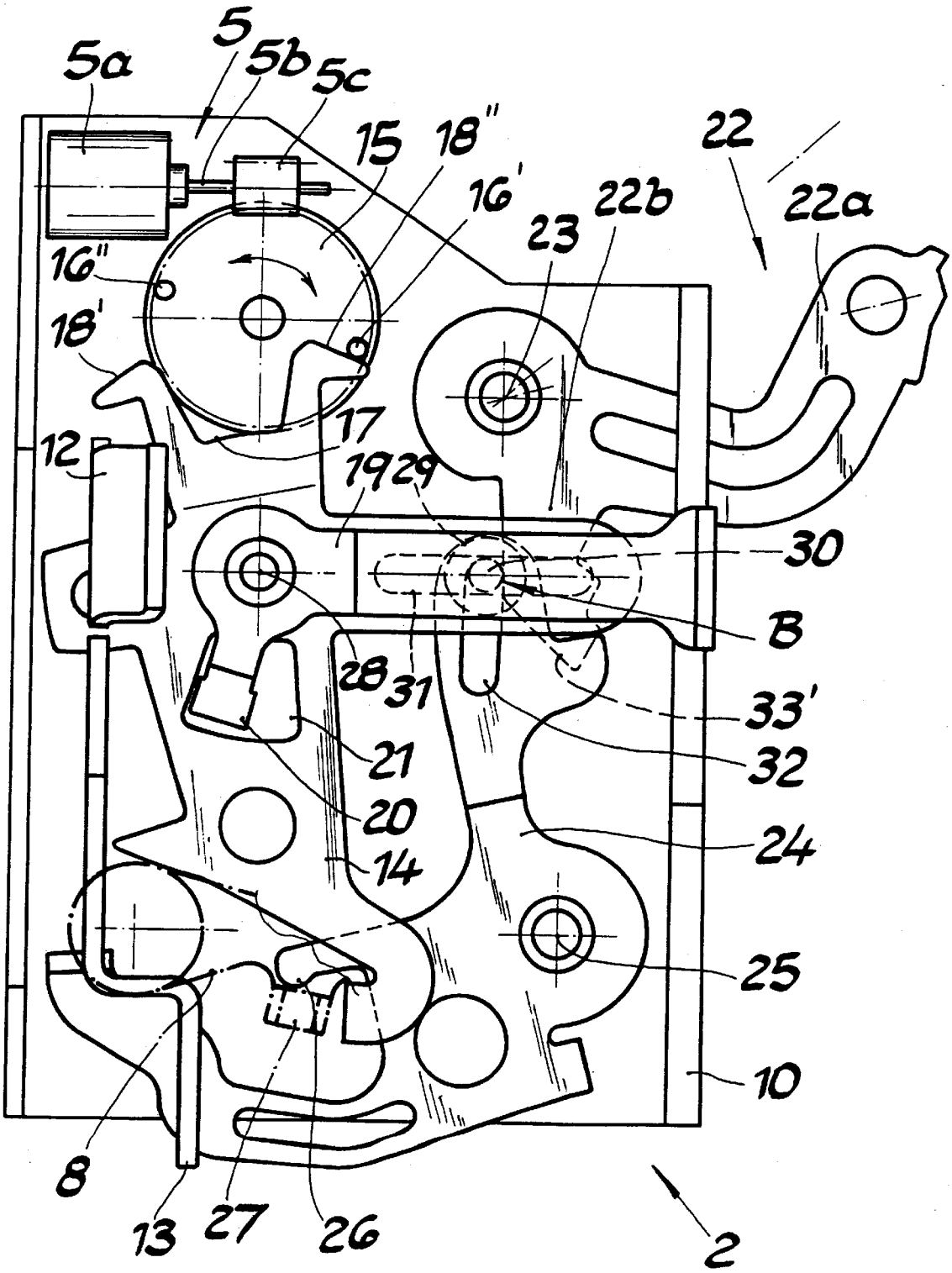
FIG. 5 is a view like FIG. 3 in the actuated and unlocked position.

A release lever 24 pivoted on the housing body 10 at 25 is formed with a nose 26 that can engage a tab 27 projecting from the pawl 8 through the housing body 10. When the lever 24 is rocked counterclockwise as seen in FIGS. 3 to 5 about its pivot 25, the nose 26 engages and presses down on the tab 27 and pushes the pawl 8 against the force of an unillustrated torque spring out of engagement with the fork 7 so it can pivot clockwise as shown in FIG. 2 to release the bolt 34 and unlatch the respective door. The pivots 23, 25, and 28 are all parallel to each other and to the rotation axis 15A.

While the inside handle 36 can be coupled permanently via the lever 13 with the release lever 24, the outside handle 37 and its lever 22 are coupled via a link pin 30 with the lever 24. To this end the main locking lever 14 is formed with a straight elongated slot 31 extending generally radially of its pivot 28 and the release lever 24 is formed with another such elongated slot 32 extending generally radially from its pivot 25 and transverse to the slot 31. The pin 30 extends through both slots 31 and 32 and is fitted with a snap ring or washer 29 between the levers 14 and 24. This pin 30 can engage cam surfaces 33' and 33" on the arm **22*b* of the lever 22**.

The latch described above operates as follows:

When unlocked as shown in FIG. 3 the pin 30 is in position A engaging the upper cam edge 33" which extends generally radially from the pivot 23. If the outside handle 37 is operated to pivot the lever 22 clockwise, this edge 33" will push the pin 30 to the left, into position B of FIG. 5, thereby causing the nose 26 to push down on the tab 25 and disengage the pawl 8 from the fork 7.

Similarly, starting from the unlocked position, the drive 5 can rotate the wheel 15 counterclockwise so the pin 16" engages in the cutout 17 and rotates the main locking lever 14 clockwise until the other pin 16' comes to rest on the surface 18' as shown in FIG. 4. This will cause the lever 14 to push the pin 30 down in the slot 32 to position C shown in FIG. 4. Actuation of the lever 22 in this position will have no effect, since the edges 33' and 33" will move past the pin 30 without touching it. The door thus is locked.

From the locked position of FIG. 4, opposite clockwise rotation of the wheel will oppositely rock the lever 14 and move it back into the unlocked position.

In addition from the locked position of FIG. 4, if the outside handle 37 is actuated before the operator 6 initiates unlocking of the latches, the drive 5 can release the fork 8 without the driver having to reactuate the handle 37 or operator 6. This is done as shown in FIG. 5, where the lever

22 is shown in the actuated position, by the drive 5 pivoting the main locking lever 14 counterclockwise so the slot 31 raises the pin 30 along the slot 32. As the pin 30 moves up toward the pivot 23, it first contacts the angled outer cam surface 33', forcing it toward the pivot 28 and thereby pivoting the release lever 24 counterclockwise about its pivot 25 and freeing the fork 7. Thus a user equipped with, for instance, a transponder 6 that is sensed by the controller 1 will always be able to open a door. If he or she actuates the handle 37 before the drive 5 has had time to move the latch 2 to the unlocked (FIG. 3) position or the operator 6 has been actuated, movement into this position will automatically unlatch the latch 2 without the user having to reactuate the handle 37.

I claim:

1. A door latch for a motor-vehicle central-latch system having a central electronic controller and an operator for the controller, the door latch comprising:

a housing;

a locking element displaceable on the housing between a position holding a door bolt and a position releasing the door bolt;

a pawl displaceable on the housing between a retaining position holding the locking element in its bolt-holding position and a freeing position allowing the locking element to assume its bolt-releasing position;

a release lever pivotal on the housing into an actuated position putting the pawl in the freeing position;

an outside operating lever pivotal on the housing between actuated and unactuated positions;

a main locking lever pivotal on the housing between locked and unlocked positions;

means including an electric motor in the housing for displacing the main locking lever between its locked and unlocked positions; and means including a link engageable between the main locking lever, the outside operating lever, and the release lever for, when the main locking lever is in the unlocked position and the outside operating lever is in its unactuated position, coupling the outside operating lever to the release lever to displace same into its freeing position on movement of the outside operating lever into its actuated position, for, when the main locking lever is in the locked position and the outside operating lever is in its actuated position, displacing the release lever into its freeing position on movement of the main locking lever into its unlocked position, and for, when the main locking lever holds in the locked position, decoupling the outside locking lever from the release lever.

2. The motor-vehicle door latch defined in claim 1 wherein the drive further includes a worm mounted on the drive motor, a worm wheel meshing with the worm, and an eccentric on the worm wheel engageable with the main locking lever.

3. The motor-vehicle door latch defined in claim 2 wherein the main locking lever has a forked end formed with a recess in which the eccentric is engageable.

4. The motor-vehicle door latch defined in claim 1 wherein the main locking lever and release lever are formed with crossing slots and the link is engaged in both of the slots.

5. The motor-vehicle door latch defined in claim 4 wherein the link is a pin engaged through both of the slots and provided with a retaining disk between the main locking and release levers.

6. The motor-vehicle door latch defined in claim 4 wherein the outside operating lever is pivotal on the housing about an axis parallel to axes of rotation of the main locking and release levers.

7. The motor-vehicle door latch defined in claim 6 wherein the outside operating lever has an angled cam edge engageable with the link n the actuated position of the outside operating lever on movement of the main locking lever from the locked position to the unlocked position.

* * * * *